US008726764B2

(12) United States Patent
Burato

(10) Patent No.: US 8,726,764 B2
(45) Date of Patent: May 20, 2014

(54) SOMMELIER'S CORKSCREW

(75) Inventor: Piero Claudio Burato, Montecchia di Crosara (IT)

(73) Assignee: Prop 12 S.A.S. di Burato Piero Claudio & C., Arzignano (VI) (IT)

( * ) Notice: Subject to any disclaimer, the term of this patent is extended or adjusted under 35 U.S.C. 154(b) by 0 days.

(21) Appl. No.: 14/004,503

(22) PCT Filed: Apr. 5, 2012

(86) PCT No.: PCT/EP2012/001512

§ 371 (c)(1), (2), (4) Date: Oct. 4, 2013

(87) PCT Pub. No.: WO2012/136368

PCT Pub. Date: Oct. 11, 2012

(65) Prior Publication Data

US 2014/0020512 A1 Jan. 23, 2014

(30) Foreign Application Priority Data

Apr. 7, 2011 (IT) ..... VI2011A0087

(51) Int. Cl.
*B67B 7/04* (2006.01)
*B67B 7/00* (2006.01)
*B67B 7/44* (2006.01)

(52) U.S. Cl.
CPC ... *B67B 7/04* (2013.01); *B67B 7/00* (2013.01); *B67B 7/44* (2013.01)
USPC ..... 81/3.47; 81/3.57; 81/3.45; 7/118

(58) Field of Classification Search
CPC ..... B67B 7/04; B67B 7/0417; B67B 7/0423; B67B 7/0447; B67B 7/06; B67B 7/16; B67B 7/14; B67B 7/0429; B67B 7/44; B67B 7/0411; B67B 2007/00; B67B 2007/02; B67B 2007/04
USPC ..... 81/3.47, 3.07, 3.35, 3.57, 3.56, 3.45, 81/3.09, 3.55; 7/132, 152, 155, 118
See application file for complete search history.

(56) References Cited

U.S. PATENT DOCUMENTS

| | | | | |
|---|---|---|---|---|
| 161,124 | A * | 3/1875 | Jenness | 7/118 |
| 2,599,968 | A * | 6/1952 | Acard | 81/3.56 |
| 6,415,689 | B2 * | 7/2002 | Castellani et al. | 81/3.47 |
| 2009/0301261 | A1 * | 12/2009 | Cellini | 81/3.45 |

FOREIGN PATENT DOCUMENTS

| | | |
|---|---|---|
| EP | 1 157 964 | 11/2001 |
| WO | WO 2008/055750 | 5/2008 |

OTHER PUBLICATIONS

International Search Report of PCT/EP2012/001512, date of mailing Jul. 27, 2012.
Written Opinion of the International Searching Authority of PCT/EP2012/001512, date of mailing Jul. 27, 2012.

* cited by examiner

*Primary Examiner* — Lee D Wilson
*Assistant Examiner* — Melanie Alexander
(74) *Attorney, Agent, or Firm* — Collard & Roe, P.C.

(57) ABSTRACT

A sommelier's corkscrew having an elongated first shaft (1) hingedly connected at one end with a second shaft (2) including a tool (2.1) for opening crown caps and an extension (2.2) having a formed step adapted to engage the top edge of a bottle mouth during the corkscrew lifting step, and a helically shaped third shaft (3) hingedly connected to the first shaft. The corkscrew further includes a mechanical element (10, 20) adapted to engage the third shaft and actuate it automatically to move the third shaft from the closed position of the corkscrew, where the third shaft is contained between the first and second shafts, to the open position where the third shaft is substantially perpendicular to the first and second shafts aligned in the open position.

4 Claims, 6 Drawing Sheets

SOMMELIER'S CORKSCREW

CROSS REFERENCE TO RELATED APPLICATIONS

This application is the National Stage of PCT/EP2012/001512 filed on Apr. 5, 2012, which claims priority under 35 U.S.C. §119 of Italian Application No. VI2011A000087 filed on Apr. 7, 2011, the disclosure of which is incorporated herein by reference. The international application under PCT article 21(2) was published in English.

The present invention relates to a sommelier's corkscrew.

As is known, the devices for sommeliers for removing the cap from the bottle, which are commonly used in wine shops, as well as in restaurants, bars but also in households, in order to allow the opening of bottles closed by caps that may be opened by the extraction from the bottlenecks, comprise a helical body to be inserted within the same cap by screwing; said caps are normally made of cork but have been recently made of plastic material too.

Such helical body is fitted into an elongated shape element which is arranged in a position substantially parallel to the latter in stand-by conditions, whereas in operation it emerges from the above.

A per se known tool is fitted to one of the two ends of the elongated shape element adapted to allow the opening of crown caps, normally used for closing bottles of mineral water and other types of non alcoholic drinks.

Moreover, as described for the corkscrew described in patent document EP 1 157 964 and in other types of similar corkscrews of the known type, the application of an extension fitted in and aligned with said tool, which forms a step capable of resting on the top edge of the bottle mouth during the corkscrew lifting step; it extends longitudinally so that, being able to slightly rotate about the axis of the connecting pin to said tool, it allows a safe contact of the whole device and in particular, of the bottom end of said extended body with the top portion of the bottleneck.

Constructively, the corkscrew described above essentially consists of three shafts where the two shafts consisting one of the elongated shape element and the other of the tool plus the extension, respectively, are reciprocally hinged whereas the third shaft, consisting of the helical body, is hinged on said elongated shape element.

With such configuration, when the device is in stand-by condition the three shafts are reciprocally side by side, with the helical body comprised between the other two, so that in order to use it, it is necessary to "open" the outer shafts imparting a substantially "cross-wise" configuration to the same device, with the two outer shafts substantially aligned and the helical body perpendicularly arranged for allowing the screwing thereof onto the cap. In the practice, in the performance of such operation, per se very simple, the greatest difficulty consists in the grip of the helical body which is normally placed in contact with, if not even partially contained within, the elongated shape element.

In the practice, once he/she has opened the two side shafts, the sommelier must grip the helical body with his/her thumb and forefinger and rotate it to move it in a perpendicular position relative to the two shafts above, an operation that even if carried out by expert personnel and which lasts a few seconds, is in any case always difficult.

The object of the present finding is to provide a corkscrew of the type described above wherein the extraction and the positioning of the helical body take places automatically, at the same time as the manual opening of the two side shafts, so that the manual gripping and rotating operation described above carried out by the sommelier is eliminated.

Such object is achieved with a corkscrew of the type described above which is characterised in that it is provided with a mechanical element, applied onto the shaft provided with the tool for opening crown caps, which engages onto the helical body and during the opening step of the two side shafts, it moves said helical body so that when said two rods are completely open, said helical body is positioned perpendicular thereto, i.e. in the screwing condition.

The finding shall be better defined with the description of some possible embodiments thereof, made by way of a non-limiting example with the aid of the attached drawing tables, wherein.

Figures 1, 2, 3:
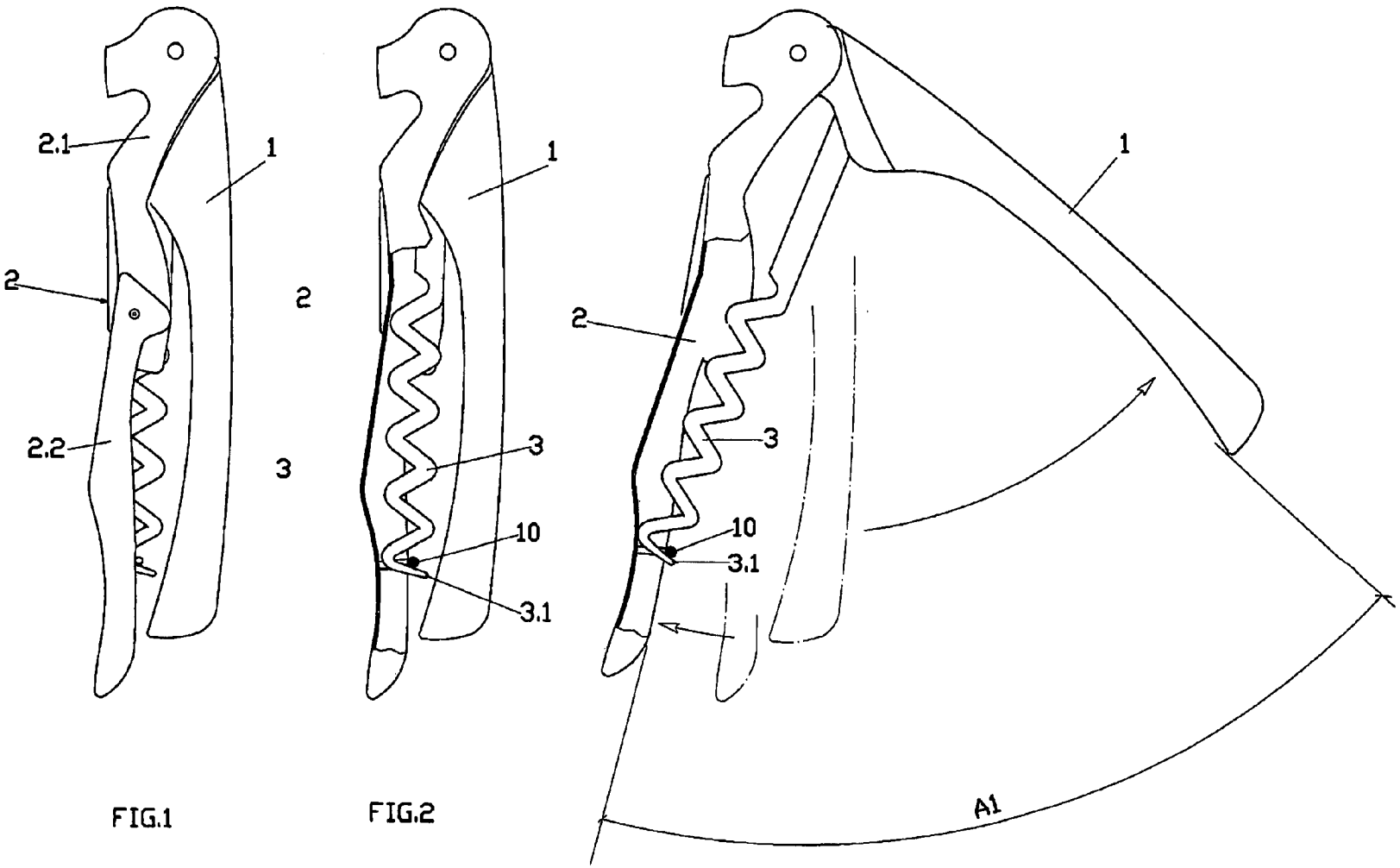
FIGS. 1-2 (tab. I) show front elevation external and cut-away views of a first embodiment of the finding.
FIG. 3 shows the first opening step of the corkscrew of FIG. 1.
Figure 6:
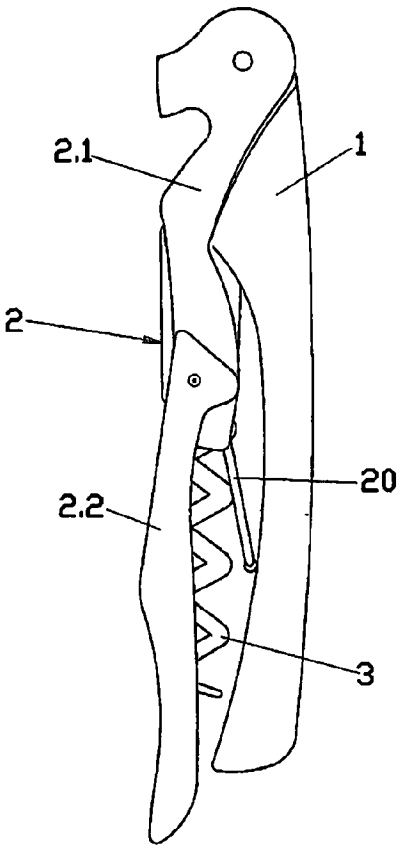

As is seen in FIGS. 1 and 6, a sommelier's corkscrew consists of a first shaft 1, shaped as an elongated body hinged at an end thereof with a second shaft 2, consisting of tool 2.1 and of extension 2.2 and of a third shaft or helical body 3, hinged on the first shaft, which in closed position of the corkscrew, is contained between the other two outermost shafts.

Figure 5:
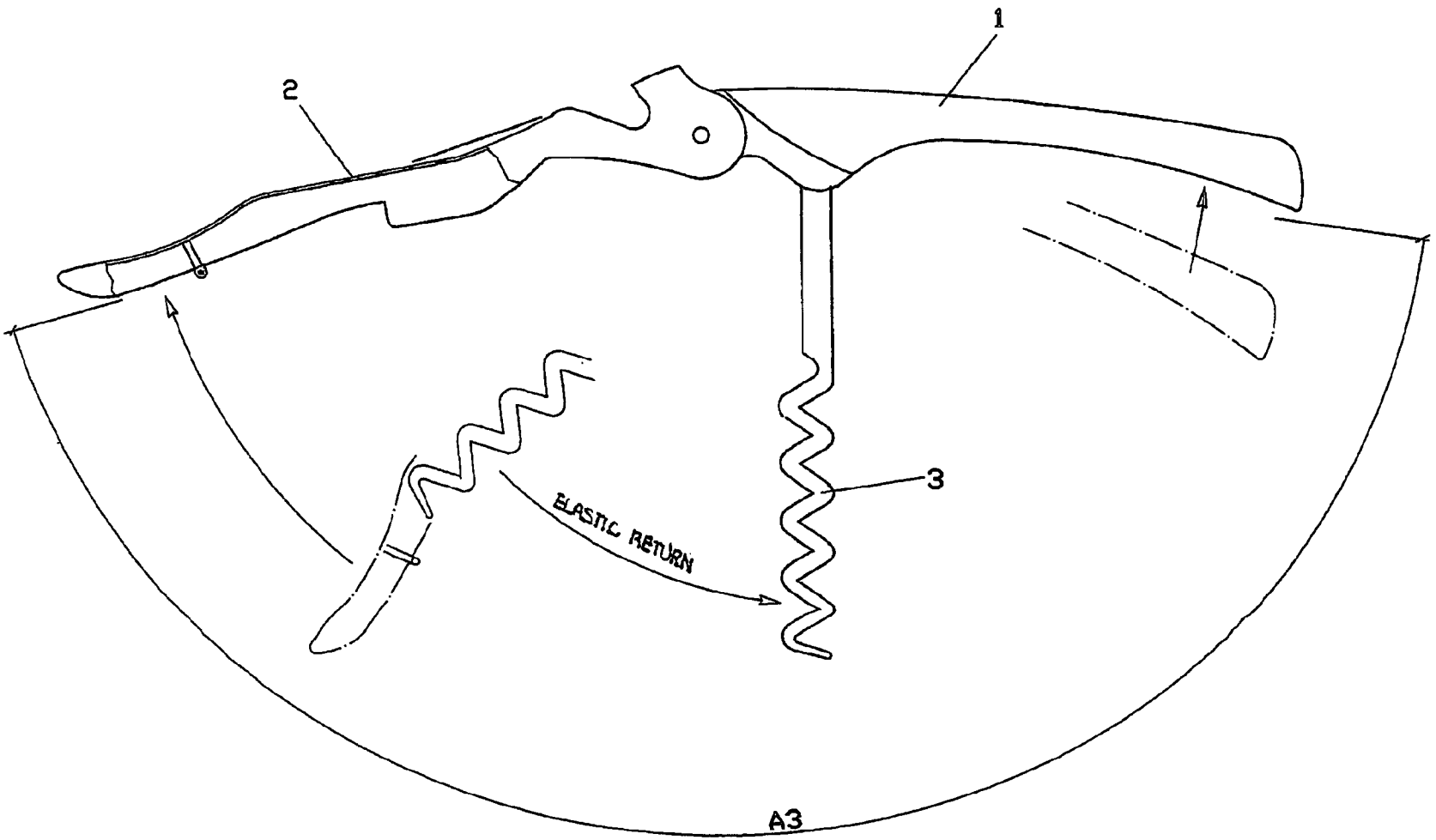
Figure 7:
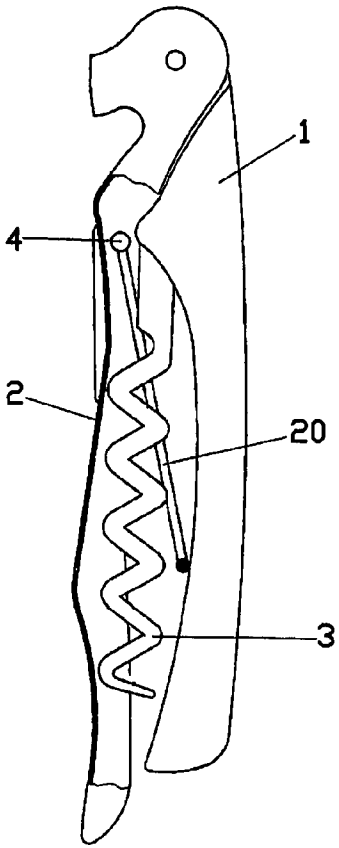
FIGS. 6-7 (tab. IV) show front elevation external and cut-away views of an embodiment of the finding.
Figure 10:
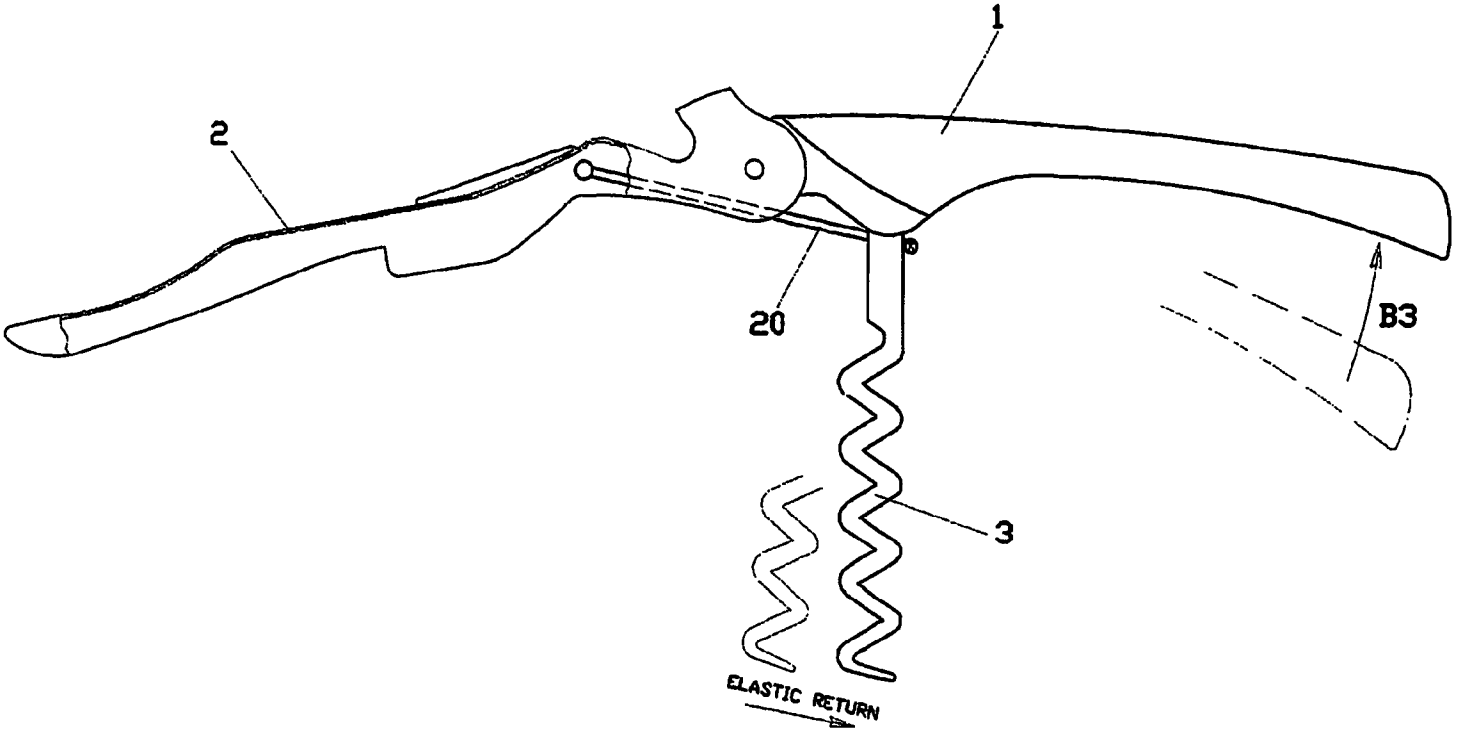

As is seen in FIGS. 2 and 7, the corkscrew of the finding is further provided with a mechanical element 10, 20 which engages with the helical body 3 and in operating conditions automatically actuates said helical body for moving it into the screwing position (FIGS. 5, 10).

As is seen in FIG. 2, in the first embodiment thereof the mechanical element consists of a linkpiece 10 stably applied in the lower part of extension 2.2 and positioned so as to hold the end part 3.1 of the helical body 3 when the corkscrew is closed.

Operatively, the provision of linkpiece 10 ensures that in the initial opening step of the two shafts 1 and 2 (FIG. 3-A1) the helical body 3, remaining locked on the linkpiece, is pulled along and thus moves away from the first shaft 1.

Figure 4:
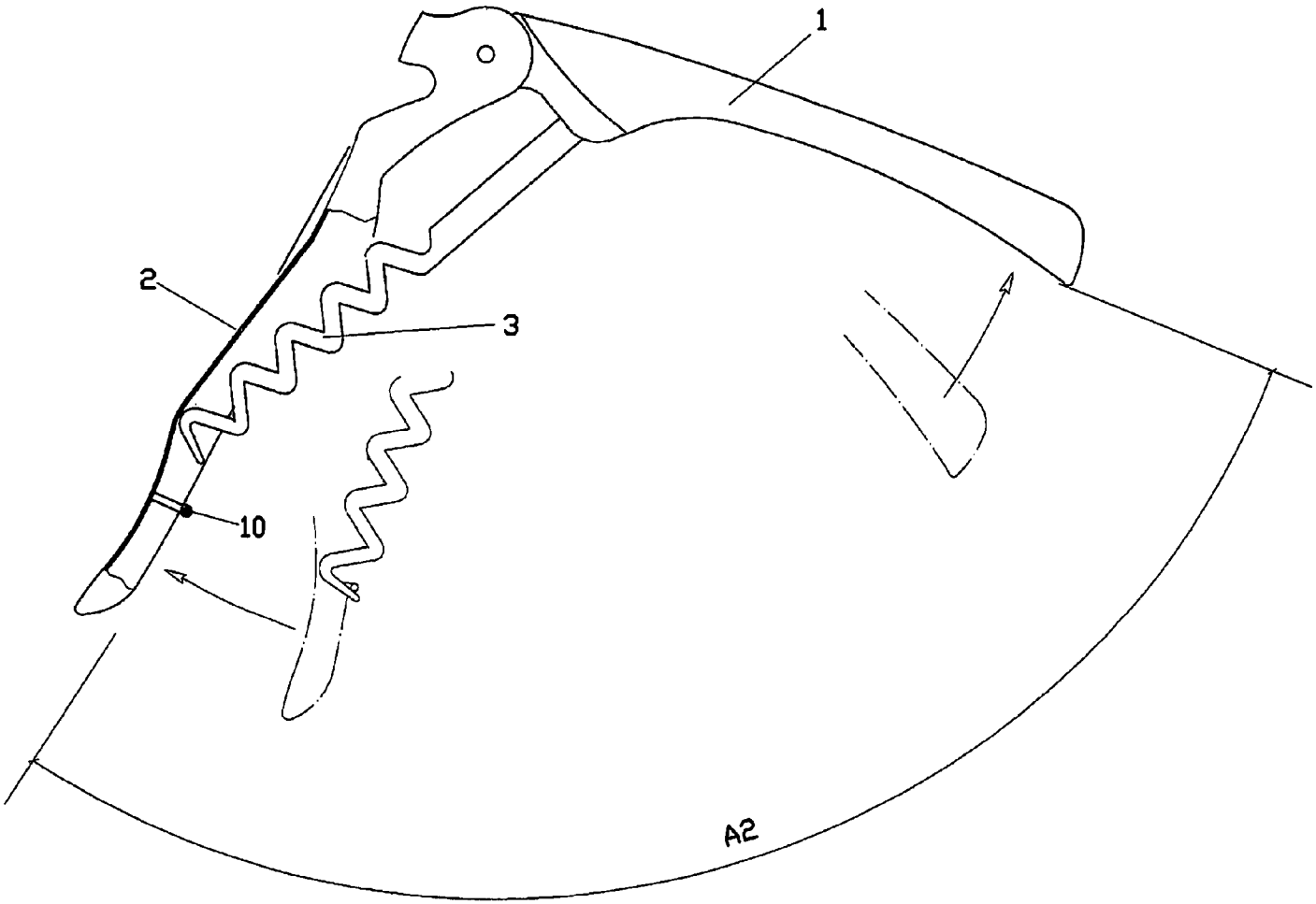
FIGS. 4-5 (tab. II-III) show the second and third opening step of the corkscrew of FIG. 1.

Thereafter, with the continued opening of the two shafts 1 and 2, (FIG. 4-A2), the lower end 3.1 of the helical body 3 releases from linkpiece 10 but is held resting against the wall of extension 2.2.

Finally, in the final opening step of the two shafts 1 and 2 (FIG. 5-A3), the helical body 3 is pulled back by the elastic return with which it is normally equipped and thus positions itself perpendicular to the aforementioned two shafts, thus automatically completing its opening.

As is seen in FIG. 6, in the second embodiment thereof the mechanical element consists of a substantially U-shaped extension 20 capable of rotating on a pin 4 fixedly connected with tool 2.2 and that aligns with the shafts when the corkscrew is closed.

Figure 8:
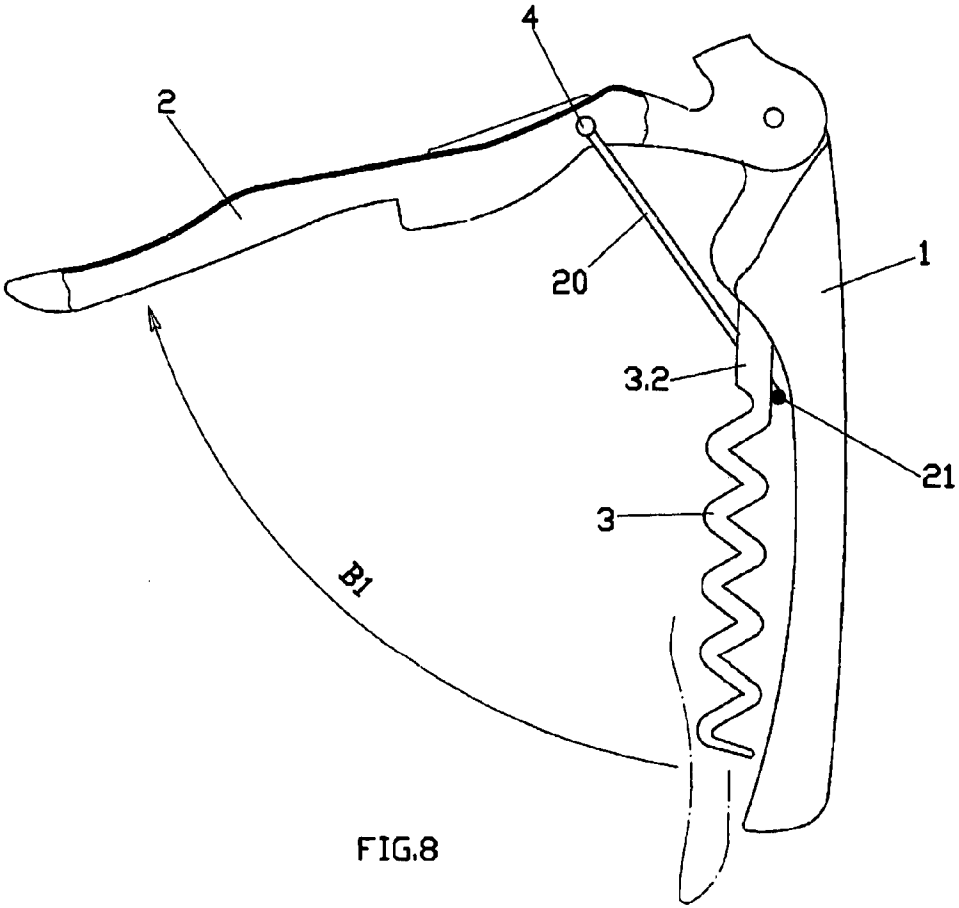
FIG. 8 shows the first opening step of the corkscrew of FIG. 6.

Operatively, in the initial opening step of shaft 2 (FIG. 8-B1), extension 20 goes from said aligned position up to the position in which the U-shaped curved part 21 surrounds the upper part 3.2 of the helical body 3.

Figure 9:
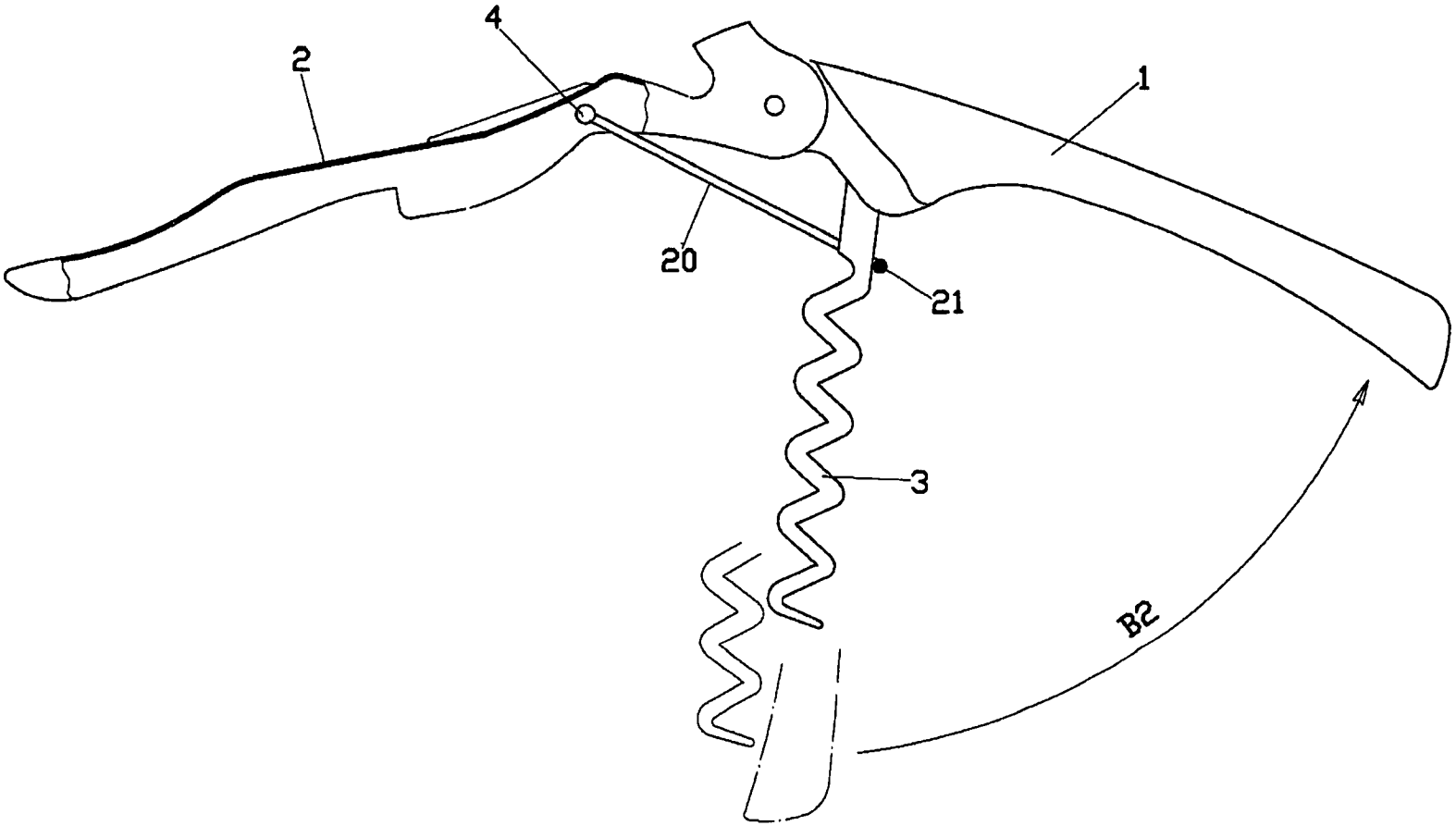
FIGS. 9-10 (tab. V-VI) show the second and third opening step of the corkscrew of FIG. 6.

Thereafter, with the opening of shaft 1 (FIG. 9-B2) the helical body 3 continues to be held by extension 20, until it is pulled back by the elastic return with which said helical body is normally provided and then it positions itself perpendicular to the aforementioned two shafts U (FIG. 10-B3), thus automatically completing its opening.

Based on what illustrated above it is clear that the above object is achieved with the provision of an effective and simple device, both from the construction and from the functional point of view.

The invention claimed is:

1. In a sommelier's corkscrew having an elongated first shaft (1) hingedly connected at a first end with a second shaft (2), said second shaft (2) including a tool (2.1) adapted for the opening of a crown-type cap and an extension (2.2) having a step formed therein adapted to engage a top edge of a bottle mouth during the corkscrew lifting step, and a spring-biased helically shaped third shaft (3) hingedly connected at a first end to said first shaft (1) and having a second free end part (3.1), the improvement comprising:

a mechanical element adapted to engage said spring-biased helically shaped third shaft (3) and actuate it to overcome the bias and move said third shaft from a closed position of said corkscrew where the third shaft (3) is contained between the first (1) and second (2) shafts to an open position where the third shaft (3) is substantially perpendicular to said first (1) and second (2) shafts substantially aligned in the open position, said mechanical element comprising a linkpiece (10) fixed to a lower part of said extension (2.2) adapted to engage and hold the free end part (3.1) of said third shaft (3) in the closed position of said corkscrew.

2. The sommelier's corkscrew as defined in claim 1, wherein said spring-biased helically shaped third shaft (3) is biased so as to be perpendicular relative to said first shaft (1) whereby when the corkscrew is closed the end part (3.1) of said third shaft (3) is held by said linkpiece (10) and upon the initial opening step of said first (1) and second (2) shafts, the third shaft (3) remains held by said linkpiece (10) to move away from said first shaft (1) until released by said linkpiece (i0), and in the final opening step of said first (1) and second (2) shafts said third shaft (3) is biased to be perpendicular to the aligned first (1) and second (2) shafts.

3. In a sommelier's corkscrew having an elongated first shaft (1) hingedly connected at a first end with a second shaft (2), said second shaft (2) including a tool (2.1) adapted for the opening of a crown-type cap and an extension (2.2) having a step formed therein adapted to engage a top edge of a bottle mouth during the corkscrew lifting step, and a spring-biased helically shaped third shaft (3) hingedly connected at a first end to said first shaft (1) and having a second free end part (3.1), the improvement comprising:

a mechanical element adapted to engage said spring-biased helically shaped third shaft (3) and actuate it to overcome the bias and move said third shaft from a closed position of said corkscrew where the third shaft (3) is contained between the first (1) and second (2) shafts to an open position where the third shaft (3) is substantially perpendicular to said first (1) and second (2) shafts substantially aligned in the open position, said mechanical element comprising a substantially U-shaped extension (20) having an open first end a closed U-shaped second end (21) and hingedly connected at said open first end with said extension (2.2) by a pin (4) whereby said U-shaped extension (20) is substantially aligned with said first (1) and second (2) shafts when the corkscrew is in the closed position.

4. The sommelier's corkscrew as defined in claim 1, wherein said spring-biased helically shaped third shaft (3) is biased so as to be perpendicular relative to said first shaft (1) whereby upon the initial opening step said second shaft (2) is moved from said first shaft (1) and said U-shaped extension (20) is moved by the spring bias during movement of said second shaft (2) so that the closed second end (21) surrounds an upper part (3.2) of said third shaft (3) and thereafter, with the opening movement of said first shaft (1), the helically shaped third shaft (3) continue to be engaged by the U-shaped extension (2) until the spring bias of the third shaft (3) causes it to be positioned perpendicular to the aligned open first (1) and second shafts.

* * * * *